United States Patent [19]

Kuraoka et al.

[11] 4,295,339

[45] Oct. 20, 1981

[54] CRYOSTAT SYSTEM UTILIZING A LIQUEFIED GAS

[75] Inventors: Yasuo Kuraoka; Yasuhiro Tsuchida, both of Sapporo, Japan

[73] Assignee: Hoxan Co. Ltd., Sapporo, Japan

[21] Appl. No.: 129,485

[22] Filed: Mar. 11, 1980

[30] Foreign Application Priority Data

Mar. 14, 1979 [JP] Japan ..... 54-29515
May 21, 1979 [JP] Japan ..... 54-68174[U]
Nov. 26, 1979 [JP] Japan ..... 54-152604

[51] Int. Cl.[3] ..... F25D 17/02

[52] U.S. Cl. ..... 62/64; 62/216; 62/514 R

[58] Field of Search ..... 62/52, 62, 64, 514 R, 62/208, 203, 216, 217

[56] References Cited

U.S. PATENT DOCUMENTS 3,106,070 10/1963 Harper et al. ..... 62/52
3,191,395 6/1965 Maher et al. ..... 62/52
4,116,017 9/1978 Oberpriller ..... 62/62

*Primary Examiner*—Ronald C. Capossela

*Attorney, Agent, or Firm*—George B. Oujevolk

[57] ABSTRACT

A cryostatic system utilizing a liquefied gas in which an object or substance to be cooled in a thermostatic chamber without a stirrer and electric heater therein is cooled initially by a liquid coolant at a cryogenic temperature for rapidly lowring its temperature to an intended level and, upon reaching the proximity of said intended level, a temperature sensor detecting the same actuates a temperature controller controlling a heat exchanger, which when actuated gasifies the liquid coolant and controls the temperature of the thus gasified coolant. Thus, upon reaching the proximity of said intended level, said object or substance is cooled by the gasified coolant to be thermostatically controlled thereto with a minimized coolant consumption. Alternatively, upon reaching said intended level, the input to the temperature controller is changed over to an output of another temperature sensor detecting the temperature of said gasified coolant, so that the temperature of said object or substance is thermostatically controlled to said intend level in accordance with the thus detected temperature of the liquefied gas sprayed thereonto.

1 Claim, 17 Drawing Figures

CRYOSTAT SYSTEM UTILIZING A LIQUEFIED GAS

BACKGROUND OF THE INVENTION

The present invention relates to equipment for thermostatically controlling the temperature of a desired object or substance such as a test sample or liquid substance placed in a thermostatic chamber to a desired cryogenic temperature, for example −170° C., by using a liquefied gas such as a carbon dioxide gas or nitrogen gas as a coolant.

BRIEF DESCRIPTION OF THE PRIOR ART

Heretofore, for thermostatically controlling the temperature of a test sample placed in a thermostatic chamber, two systems as schematically shown in FIGS. 1 and 2 have been proposed.

In the first system shown in FIG. 1, a coolant is continuously fed as gasified from a liquefied gas source (not shown) at a constant rate in the direction of arrow A into a thermostatic chamber B, where the gas coolant has its temperature controlled by a controlled exicitation of a heater C in the order of 1.5 KW provided therein. The temperature of the heater C is controlled by a temperature controller E which is responsive to a temperature sensor D provided in the thermostatic chamber B. In this type of thermostatic chamber or cryostat, since it is necessary to uniformalize the temperature distribution in the thermostatic chamber B, a fan F is provided therein.

Thus, although the internal temperature of the thermostatic chamber B may be lowered at a relatively high cooling rate because the gas coolant is continuously fed therein at a constant rate, the improvement in the cooling rate is inevitably limited in that the entire thermostatic chamber must be cooled. As a factor making the situation more difficult, since the gas coolant fed at a constant rate has its temperature controlled through the heater C, it is unavoidable that the gas coolant under the thermostatic control is consumed in an increased quantity.

As further shortcomings of this type of cryostat system, since the fan F must be used, the gas temperature which is uniform in the thermostatic chamber may not be detected accurately and, thus, a sufficient accuracy of temperature stability may not be achieved therein depending on the specific place of the temperature sensor D. In addition, heat may be dissipated to the outside through the fan F, and the movable parts, namely the fan F and its associated parts, provided in the cooling space may cause various troubles.

While, in the second cryostat or thermostatic chamber system as shown in FIG. 2, the heater C as used in the first system shown in FIG. 1 is not used, but a temperature controller E′ is responsive to the temperature sensor D′ provided in a thermostatic chamber B′ to open and close a solenoid valve G for controlling the feed flow rate of the gas coolant so as to thermostatically control the internal temperature of the thermostatic chamber B′.

Thus, the second system of FIG. 2 also is not free from the drawbacks that the internal cooling rate of the thermostatic chamber A′ is low and that the fan F′ cannot be dispensed with. Further, although a certain improvement may be achieved in respect of the liquefied gas consumption, the temperature response to the controlling operation is bad because the temperature is controlled by regulating the feed gas coolant flow rate or turning on and off the feed gas coolant flow. Thus, the accuracy of the temperature stability in the thermostatic chamber is also low.

SUMMARY OF THE INVENTION

Accordingly, an object of the present invention is to radically solve the foregoing problems of the prior art cryostat or thermostatic chamber systems by providing an improved system as schematically shown in FIG. 3. That is to say, as shown in FIG. 3, a pair of spray nozzles 2, 2′ have their tip ends oppositely disposed in a thermostatic chamber 1 at positions adjacent to an object constituting a test sample T placed in the thermostatic chamber 1 so that a coolant X is jetted directly onto the test sample T. Thus, in the cryostat system according to the present invention, the internal temperature of the thermostatic chamber 1 is not uniform, but the coolant X jetted out of the spray nozzles 2, 2′ is used to directly cool the test sample T and, thus, only the nearby atmosphere surrounding the test sample T is thermostatically controlled at an intended cryogenic temperature.

Hereinafter, the present invention will be described in greater detail by way of the preferred embodiments with reference to the accompanying drawings, in which:

Figure 1:
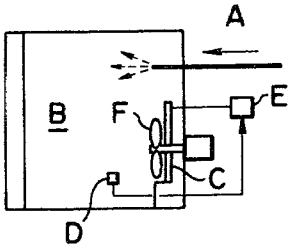
FIG. 1 is a schematic diagram of a typical cryostat system of the prior art.
Figure 2:
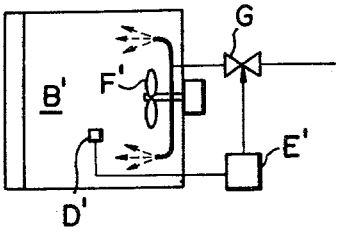
FIG. 2 is a schematic diagram of another typical cryostat system of the prior art.
Figure 3:
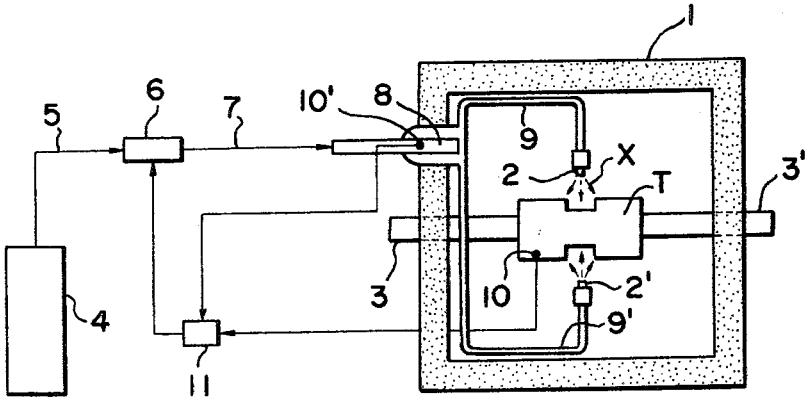
FIG. 3 is a schematic diagram of one preferred embodiment of the cryostat system according to the present invention as viewed from the side thereof.

Referring now to the drawings, especially to FIG. 3, numerals 3' are supporting rods which are provided, as required, in and across the thermostatic chamber 1 for holding the test sample T at a predetermined position. The coolant is fed from a liquefied gas source 4 to the spray nozzles 2, 2' through a passage including a transfer pipe 5, heat exchanger 6, feed pipe 7, feed port 8 and branched tubes 9, 9'.

The reference numeral 10 is a temperature sensor for detecting surface temperature of the test sample T, while another temperature sensor 10' is provided in the feed port 8 for detecting the temperature of the coolant X jetted out of the spray nozzles 2, 2'. A temperature controller 11 is responsive to the data detected by the temperature sensor 10, 10' to control the temperature of a heat source 12 of the heat exchanger 6.

Figure 4:
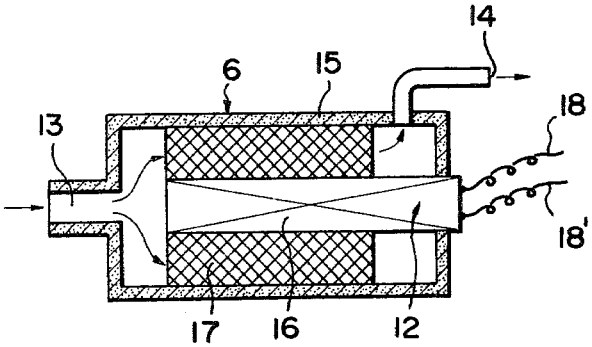
FIG. 4 is a schematic longitudinal section of a heat exchanger used in the cryostat system of FIG. 3.

The aforesaid heat exchanger 6 may be arranged, for example, as shown in FIG. 4. In FIG. 4, the heat exchanger 6 has a body 15 having an inlet 13 coupled to the transfer pipe 5 and an exit coupled to the feed pipe 7. Inside the body 15 of the heat exchanger 6, provided are a heat source 16 such as an electric heater and a heat transfer medium 17 packed around the electric heater 16 so as to provide there a heat transfer passage. Thus, as the coolant X flowing in from the inlet 13 passes through the heat transfer medium or passage 17, it is adequately heated by the electric heater 16.

As the heat transfer medium 17, it is preferable to use a circularly formed sintered metal or a thin metal wires. In FIG. 4, numerals 18, 18' are lead wires of the electric heater 16.

To thermostatically control the temperature of the test sample T, first a liquid coolant such as liquefied nitrogen is fed from the liquefied gas source 4 such as a liquefied nitrogen bomb through the heat transfer pipe 5, heat exchanger 6 and feed pipe 7 into the thermostatic chamber 1 to be jetted out of the spray nozzles 2, 2' onto the test sample T.

Figure 5:
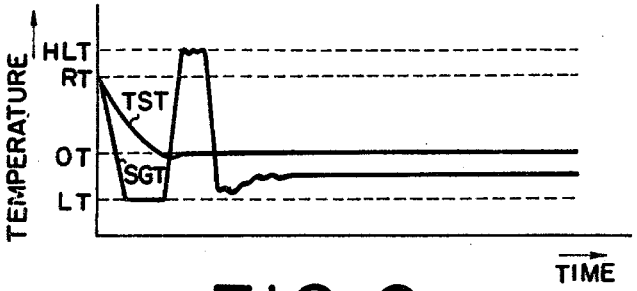
FIG. 5 is a chart plotting the controlled temperature against the thermostatic controlling time obtained by using the cryostat system according to the present invention.

Assuming here that the spray nozzles 2, 2' has a capacity of 1 l/min. (1 Kg/cm$^2$), the liquefied nitrogen at −196° C. is sprayed out onto the sample T at a rate of 0.808 kg/min. (the liquefied nitrogen having a specific gravity of 0.808 at −196° C.). Thus, since the test sample T is cooled by a great quantity of the coolant of sufficiently low temperature, the surface temperature of the test sample T continues to decrease rapidly along the test sample surface temperature curve TST, as shown in the chart of FIG. 5 until it reaches the proximity of an intended or objective temperature, because the temperature of the coolant jetted out of the spray nozzles 2, 2' is decreased from a room temperature at a sharp gradient against time along the coolant temperature curve SGT shown in FIG. 5 to reach the liquid coolant temperature LT and to be retained thereat.

When the surface temperature of the test sample T is lowered to an upper or lower proximity of the intended temperature OT, the temperature sensor 10 detects it to actuate the temperature controller 11. Then, the temperature controller 11 acts to turn on the electric heater 16 of the heat exchanger 6. Thus, since the electric heater 16 heats the liquid coolant passing through the heat exchanger 6 to gasify the same, the temperature of the gasified coolant sprayed out of the spray nozzles 2, 2' increases steeply as shown in the chart of FIG. 5.

Figure 6:
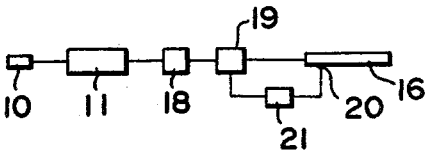
FIG. 6 is a block diagram of a high-limit circuit used in the cryostat system of FIG. 3.

In the meantime, a higher temperature limit HLT is preset for preventing an overheat of the electric heater 16. To accomplish this, a high-limit sensor 20 is provided at the electric heater 16 forming a circuit as shown in FIG. 6 together with the temperature sensor 10 for the test sample T, temperature controller 11, a thyristor 18 and a relay 19. Upon detecting the higher limit temperature of the electric heater 16, the high-limit sensor 20 actuates an on-off controller 21 to cut off the relay 19, which in turn cuts off the electric heater 16 for preventing the same from being overheated above the HLT level. Thus, the temperature of the coolant jetted out of the spray nozzles 2, 2' is rapidly decreased down to a level lower than the intended temperature OT. In the control system resulting in the temperature control curve of FIG. 5, the temperature controller 11 repeats thereafter the aforementioned action for controlling, through the heat exchanger 6, the temperature of the gas coolant sprayed out of the spray nozzles 2, 2' to retain the surface temperature of the test sample T substantially at the intended temperature OT while monitoring the surface temperature through the temperature sensor 10.

Figure 7:
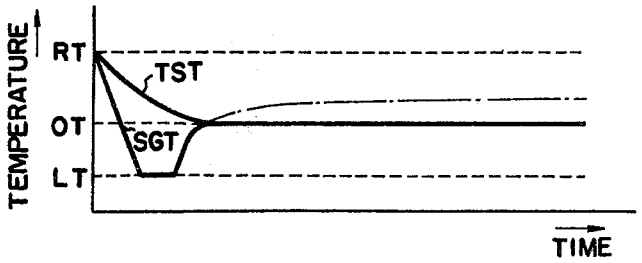
FIG. 7 is a chart plotting the controlled temperature against the thermostatic controlling time obtained by using the cryostat system according to the present invention in a manner different from the controlling manner that gave the chart of FIG. 5.

While, in the thermostatic control system giving the temperature control curve of FIG. 7, the temperature sensor 10 is used to detect the surface temperature of the test sample T for bringing down the same to the intended temperature OT at the initial test sample cooling step. However, once the surface temperature of the test sample T reach the intended temperature OT or the proximity thereof, the sensed temperature input to the temperature controller 11 is changed over to the output of another temperature sensor 10' provided in the feed port 8. That is to say, the temperature of the gas coolant itself sprayed out of the spray nozzles 2, 2' detected by the temperature sensor 10' is used to control the gas coolant temperature at the spray nozzles 2, 2', for finally controlling thermostatically the surface temperature of the test sample T to the intended temperature OT. In FIG. 7, the chain line shows the surface temperature curve of the test sample T held by the supporting rods 3, 3'. As seen from the chart of FIG. 7, the test sample T has its surface temperature thermostatically controlled to a level slightly above the intended temperature OT.

Figure 8:
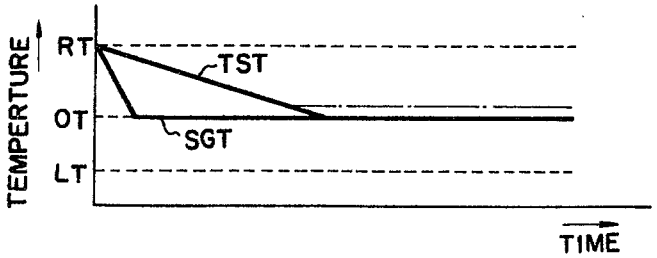
FIG. 8 is a chart plotting the controlled temperature against the thermostatic controlling time obtained by using a thermostatic controlling means different from that used in the schemes that gave the charts of FIGS. 5 and 7.

Unlike the thermostatic control systems described with reference to FIGS. 5 and 7, the thermostatic control is effected initially by using the temperature sensor 10' to detect the coolant temperature, in the case of FIG. 8. In this case, the coolant temperature does not go below the intended temperature OT and, thus, the cooling rate of the test sample is lower than those achieved in the case of FIGS. 5 and 7.

As fully described hereinbefore, according to the present invention, since the coolant X fed from the liquefied gas source 4 through the heat exchanger 6 is jetted out of the spray nozzles 2, 2' provided in the thermostatic chamber 1 directly towards the test sample T placed therein, the thermostatic chamber 1 is cooled only in a nearby area surrounding the test sample T without cooling the entire thermostatic chamber 1. Thus, not only an extremely high cooling rate can be achieved, but also a fan for uniformalizing the temperature distribution of the thermostatic chamber can be dispensed with and the response to the controlling operation can be effectively improved.

Further, according to the present invention, the coolant is jetted as a liquid directly onto the test sample T in the initial cooling step. For example, liquefied nitrogen at −196° C. can be sprayed out at a rate of 0.808 Kg/min. if the spray nozzles 2, 2' have a capacity of 1 l/min. as mentioned previously. Thus, the cryostat system according to the present invention can realize a cooling rate far higher than that of the prior art systems. For example, the cryostat system according to the present invention can decrease the surface temperature of a test sample from a room temperature to −100° C. in approximately 20 minutes by using liquefied nitrogen as the coolant. Thereafter, the heat exchanger acts, from time to time, to gasify the liquid coolant and control the temperature of the gasified coolant for thermostatically controlling the test sample surface temperature to the intended level. Accordingly, when the test sample surface temperature is thermostatically controlled to −100° C. by gasifying the liquefied nitrogen and spraying the same onto the test sample at a rate of 1 l/min., the weight flow rate of the gas coolant is automatically controlled to 0.002 Kg/min. because the nitrogen gas has a specific gravity of 0.002 at −100° C. Consequently, the coolant consumption can be effectively minimized during the thermostatic control operation.

Therefore, the heat source 12 of the heat exchanger 6 can be operated by a small electric power during the thermostatic control operation and, in fact, it has been experimentally shown that the cryostat system according to the present invention consumes only 0.5 KW for its thermostatic control operation as compared with 1.5 KW required by the prior art systems.

Further, according to the present invention, since the coolant is continuously sprayed out into the thermostatic chamber without turning on and off the feed coolant flow as prevalent in the prior art system, it is possible to avoid such a situation that the coolant temperature undesirably rises due to a cooling energy loss through the piping when the feed coolant flow is turned off, resulting in an unstable thermostatic control caused by a spray of a higher temperature coolant upon turning on the feed flow. Thus, according to the present invention, the accuracy of temperature stability can be improved to approximately ±0.5° C.

Further, since the temperature controller 11 detects, through the first temperature sensor provided at the test sample, that the test sample temperature has come close to the intended temperature by being cooled by the liquid coolant sprayed thereonto and since the temperature controller 11 responds to the thus sensed temperature for controlling the temperature of the heat source 16 of the heat exchanger 6, the test sample temperature can be thermostatically controlled in a positive manner as shown in FIG. 5. Once the temperature of the test sample T has been brought to the proximity of the intended temperature OT by controlling the heat source temperature as mentioned above, the temperature input to the temperature controller 11 for controlling the heat source 16 of the heat exchanger 6 is changed over to the output of the second temperature controller detecting the temperature of the gas coolant. Therefore, stable thermostatic control can be realized as shown in FIG. 8 with much an improved response characteristic.

Hereinafter, a description will be made on an exemplary application of the present invention in which a test material such as an iron plate held at its opposite ends as action points is subjected to a tensile test in the thermostatic chamber instead of mere a cooling of the foregoing test sample T. That is to say the cryostat system of the present invention may be used in the following manner for subjecting the test material to a tensile test under a predetermined cryogenic or semi-cryogenic condition.

Figure 9:
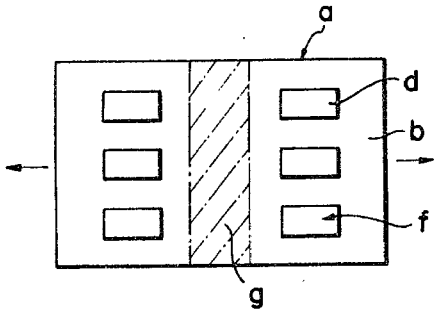
FIG. 9 is a front view of a test sample material tested in the prior art thermostatic control system.
Figure 10:
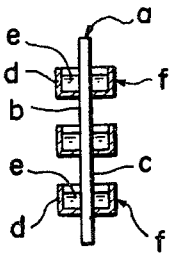
FIG. 10 is a longitudinal section of the test sample material of FIG. 9.

Heretofore, for executing such a test under a cryogenic or semi-cryogenic condition, a required number of receptacles f for retaining a liquid coolant e such as liquefied nitrogen has been formed by sticking blank materials d such as wooden pieces onto the front side b and rear side c of the test material a, as shown in FIGS. 9 and 10, so that a test operator appropriately adjust the quantity of the liquid coolant e contained in the receptacles f for keeping a test zone g of the test material a at a predetermined cryogenic or semi-cryogenic temperature.

In such a prior art arrangement, however, the operator must work in an adverse and dangerous environment. Also, the operation for maintaining the test zone g at a predetermined cryogenic or semi-cryogenic temperature requires a high level of skill. Nevertheless, since such an operation is carried out manually, sufficient accuracy of temperature stability cannot be achieved however skillful the operator may be. Further, since the test zone g is broken, with the liquid coolant e contained in the receptacles f, under a tensile force exerted on the opposite ends of the test material a, not only the liquid coolant is wastefully consumed but also the operator is exposed to danger.

Figure 11:
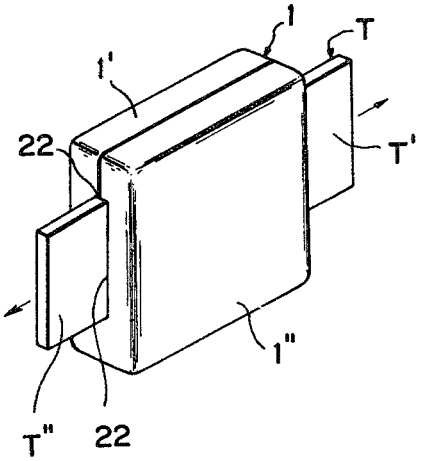
FIG. 11 is an oblique view of a test material as held in one preferred form of the thermostatic chamber according to the present invention.

While, in the preferred configuration of the thermostatic chamber according to the present invention shown in FIG. 11, the test material T to be cooled is held in the thermostatic chamber 1, comprising a heat-insulating container formed of a synthetic resin or the like material, in such a manner that the opposite ends of the test material T is extended out of the thermostatic chamber 1 to provide action points T', T'' on which an external force is exerted in the tensile or the like test of the test material T.

As shown in FIG. 11, the heat-insulating container or thermostatic chamber 1 is composed of a making pair of container halves 1', 1'' having cutouts 22, 22' which squeezingly hold the test material T. The thermostatic chamber 1 composed of said container halves defines therein a heat-insulating space where the middle portion of the test material T including its test zone TP is located.

Figure 12:
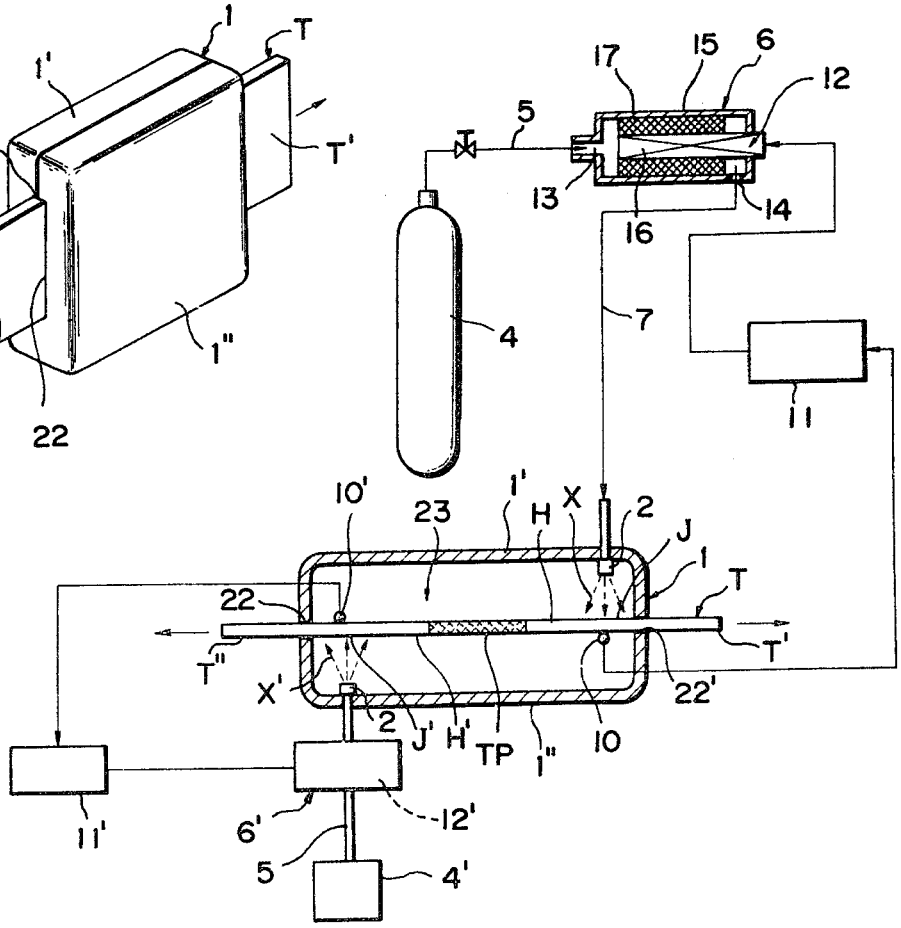
FIG. 12 is a schematic diagram of another preferred embodiment of the cryostat system according to the present invention showing some components partially broken.

Within the heat-insulating space 23, provided are coolant spray nozzles 2, 2' each extended thereinto through the walls of the container halves 1', 1'' towards the front side H and rear side H' of the test material T at the opposite lateral sides of it test zone TP, as shown in FIG. 12.

Further, as shown in FIG. 12, the coolant is fed to the spray nozzles 2', 2 from their associated liquid coolant sources, 4, 4' namely coolant containers containing a liquid coolant such as liquefied nitrogen, through their associated transfer pipes 5, 5' and first and second heat exchangers 6, 6', respectively. Also, a first and second temperature sensors 10, 10' are attached to the surfaces of the test material T on the opposite sides thereof to the associated spray nozzles 2, 2', respectively, at positions J, J' where the coolants X, X' sprayed out thereof impinge onto the test material T, so that the sensors can detect the temperature of the test material T at those positions.

The first and second temperature sensor 10, 10' are connected to their associated temperature controllers 11, 11' of which outputs are used to control heat sources 12, 12' such as electric heaters 16 provided in the first and second heat exchangers 6, 6', respectively.

Here, the first and second heat exchangers 6, 6' have substantially the same configuration as that previously described with reference to FIG. 4. Therefore, upon turning on the cryostat system of FIG. 12, the test material T is cooled on the opposite lateral sides of its test zone TP by the coolant X, X' sprayed out of the spray nozzles 2, 2'. Thus, while cooling, the heat transferred from the action points T', T'' of the test material T is shut off from effecting on its test zone TP located in the heat-insulating space 23 in which the sprayed coolant is entrapped. Further, the temperatures of the test material T at positions J, J' where the sprayed coolants impinge thereon are detected by the temperature sensors 10, 10' provided on the opposite sides to their associated spray nozzles at said positions J, J'. The thus detected temperatures are fed through the first and second temperature controllers 11, 11' to the heat sources 12, 12' of the heat exchangers 6, 6' for controlling electric current supplied thereto. In this manner, since the temperatures of the test material at said positions J, J' are automatically adjusted constantly to a predetermined level, the test zone TP of the test material T can be thermostatically controlled to a desired temperature as required by a tensile or the like test.

To describe an example of applications of the present preferred cryostat system, an iron plate 900 mm long, 500 mm wide and 22 mm thick was used as the test material, and a liquefied nitrogen bomb of 1.0 kg/cm$^2$ as the liquid coolant source. While, the first and second heat exchanger each had a 500 W electric heater, and the test zone was defined at the central portion of the test material as 500 mm wide and 210 mm long. In this test, the accuracy of temperature stability could be kept always within ±20° C., and the cooling rate was about 2.7° C./min. as measured from 20° C. to stabilized −100° C.

For initially cooling the test material from a room temperature, it is preferable to spray, onto the test material, the liquid coolant or liquefied nitrogen without being heated and gasified by the heat exchangers so that the test material is cooled to an intended temperature at a high cooling rate, as a matter of course. Then, once the intended temperature is reached, the test material may preferably be cooled by the coolant heated and gasified by the heat exchangers.

Figure 13:
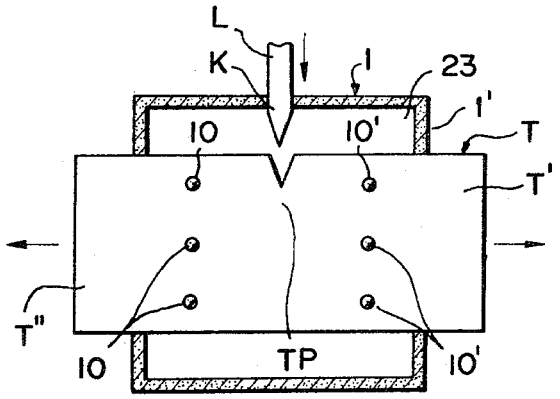
FIG. 13 is a schematic frontal view of a test material as held in another preferred form of the thermostatic chamber according to the present invention.

Hereinafter, a description will be made with reference to FIGS. 13 and 14, on a further preferred embodiment of the cryostat system according to the present invention as applied to a rupture test, in which a cutting tool L is struck through the upper wall of the thermostatic chamber 1 downwardly against the test material T at its upper central notch K. In this test, it is assumed that a predetermined temperature gradient must be given to the test material from the higher temperature at the upper part towards lower temperature at the lower part thereof.

Figure 14:
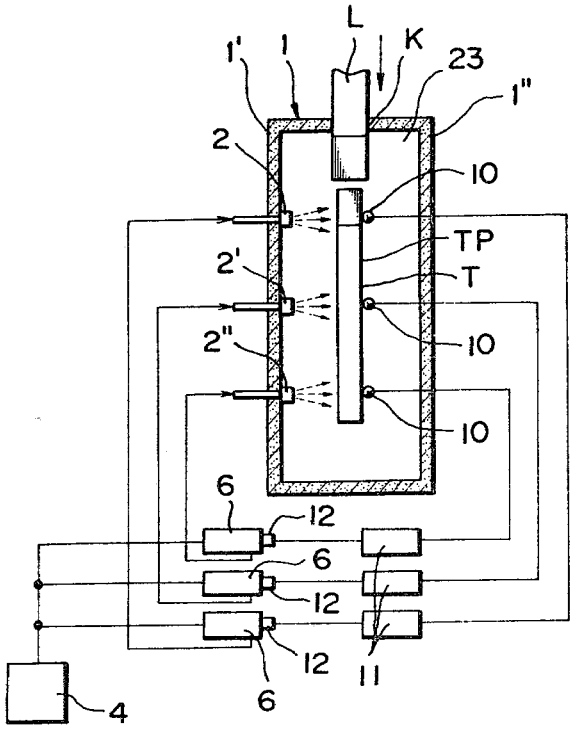
FIG. 14 is a schematic cross section of the thermostatic chamber of FIG. 15.

For this purpose, an arrangement as shown in FIG. 14 may be used. More specifically, a plurality of pairs of spray nozzles 2, 2' are extended at varied heights into the thermostatic chamber 1 through one side wall thereof so that the coolant is sprayed against the test material T at positions, having said varied heights, on opposite lateral sides of the test zone TP of the test material T. Also, a plurality of pairs of temperature sensors 10, 10' are provided on other side of the test material T opposite to said spray nozzles 2, 2' at positions corresponding thereto.

Then, the temperature controllers 11 connected to their associated pairs of temperature sensors 10, 10' control the heat sources 12 of their associated heat exchangers 6, respectively.

Hereinafter, a description will be made, with reference to FIGS. 15 through 16, on a further another preferred embodiment of the cryostat system according to the present invention as applied to a case in which, instead of a solid test material as used in the preceding preferred embodiments, a liquid substance is cooled for thermostatically controlling its temperature to a predetermined cryogenic level.

Heretofore, to thermostatically control the temperature of such a selected a liquid substance, an equipment has been used in which a liquid coolant such as liquefied nitrogen is fed from a high-pressure liquefied gas vessel directly into a thermostatic chamber of the equipment filled with the liquid substance.

In such a prior art equipment, however, since the coolant such as liquefied nitrogen is directly fed, without being gasified, into the liquid substance to be cooled, a stirrers or agitator must be provided in the thermostatic chamber for mixing the liquid coolant with the liquid substance and uniformalizing the temperature distribution therein. Therefore, not only the thermostatic chamber must have a space for the stirrer, but also the stirrer is susceptible to troubles because of the use under a cryogenic condition. Further, the coolant tends to be consumed wastefully because it is fed continuously as a liquid. In addition, for heating the liquid substance cooled to a temperature below an intended level, an electric heater or the like means must be otherwise provided in the thermostatic chamber. This also occupies the internal space of the thermostatic chamber undesirably.

Figure 15:
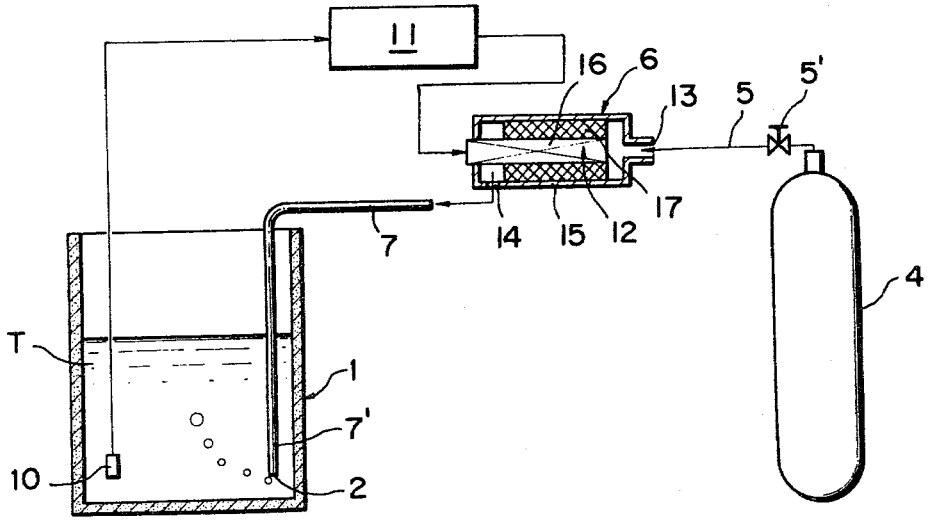
FIG. 15 is a schematic diagram of a further preferred embodiment of the cryostat system according to the present invention showing a piping system thereof.

While, the preferred embodiment of the cryostat system according to the present invention shown in FIG. 15 is free from such drawbacks of the prior art equipment. In FIG. 15, the reference numeral 4 is a liquefied gas source such as a liquefied nitrogen bomb having its feed port connected through a transfer pipe 5 to an inlet 13 of a heat exchanger 6. An outlet 14 of the heat exchanger 6 is connected to one end of a feed pipe 7 having its other end connected to a discharge pipe 7' immersed in the liquid substance T to be cooled in the thermostatic chamber 1. A discharge port 2 is opened at the free end of the discharge pipe 7'.

Here, the heat exchanger 6 used in the present embodiment has substantially the same configuration as those described previously. 11 is a temperature controller which control the current supply to an electric heater 16 of the heat exchanger 6 for controlling its temperature. The input of the temperature controller 11 is connected to a temperature sensor 10 extended into the thermostatic chamber 1.

In operation, a liquid substance T such as isopentane or Freon 11 which is a liquid at room temperatures or liquefied Freon 12 is first filled in the thermostatic chamber 1. Then a cock 5' connected to the transfer pipe 5 is opened to supply the liquid coolant to the heat exchanger 6.

Since the electric heater 16 is not turned on at the intial cooling step, the coolant passes, as a liquid, through the heat exchanger 6 and the feed pipe 7 to be fed into the liquid substance T from the discharge port 2 of the discharge pipe 7'. Thus, the liquid substance T is cooled steeply to an intended temperature or the proximate thereof, when the temperature sensor 10 actuates the temperature controller 11 to supply a predetermined magnitude of electric current to the electric heater 16. Thus, as the liquid coolant passes through a heat transfer passage 17 provided in the heat exchanger 6, it is gasified by the heat emitted by the electric heater 16, and the gasified coolant adjusted to a predetermined temperature is spouted out as bubbles into the liquid substance in the thermostatic chamber 1.

Therefore, not only the liquid substance in the thermostatic chamber 1 is thermostatically controlled by the gasified coolant to the intended cryogenic or semi-cryogenic temperature, but also the entire liquid substance can rapidly achieve a uniform temperature distribution throughout the thermostatic chamber 1 because it is agitated sufficiently by the bubbing gas coolant.

Figure 16:
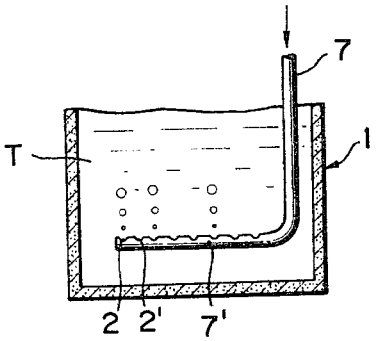
FIG. 16 is a partial section of one preferred form of the thermostatic chamber used in the cryostat system of FIG. 16, showing the lower part thereof.
Figure 17:
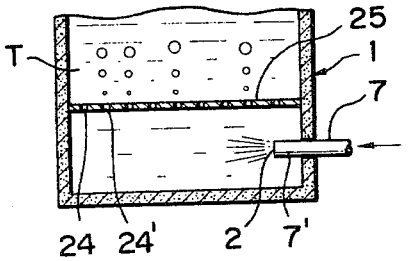
FIG. 17 is a partial section of another preferred form of the thermostatic chamber used in the cryostat system of FIG. 15, showing the lower part thereof.

For ensuring that the liquid substance T is sufficiently agitated by the gas coolant spouted out of the discharge pipe 7', it is preferred that the discharge pipe 7' connected to the vertically extending feed pipe 7' is bent so as to run horizontally along and nearby the bottom of the thermostatic chamber 1 and that a plurality of discharge ports 2 are formed upwardly in the wall of the discharge pipe 7', as shown in FIG. 16.

Further, in case where the liquid substance T overflows the thermostatic chamber 1 by the action of the gas coolant spouting out of the discharge ports 2 of the discharge pipe, it is preferred that a perforated plate 25 in which a plurality of holes 24, 24' are formed is provided horizontally in the thermostatic chamber 1 at a position above the discharge pipe 7' extended into thermostatic chamber 1 through the side wall thereof and opened in the proximity of the bottom thereof.

In this preferred arrangement of the cryostat system according to the present invention, the liquid coolant such as liquefied nitrogen can be fed, as liquid, into the liquid substance T when it is required to rapidly cool the liquid substance T down to a cryogenic or semi-cryogenic temperature. Also, for thermostatically controlling the temperature of the liquid substance T to an intended cryogenic or semi-cryogenic temperature once it is reached, the coolant as gasified and controlled to predetermined temperature by the heat exchanger 6 is fed into the liquid substance T while sufficiently agitating the latter. Therefore, it is not necessary to provide such a stirrer or the like means that wastefully reduces the effective internal space of the thermostatic chamber 1 and that has mechanical parts susceptible to troubles under a cryogenic condition. Thus, according to the present invention, a cryostat system of higher reliability can be provided with an increased effective internal space of the thermostatic chamber 1.

Further, according to the present invention, since a satisfiable thermostatic control can be achieved without providing an electric heater or the like means in the thermostatic chamber, the effective internal space of the thermostatic chamber can be increased also in this respect. In addition, since the coolant is fed under a predetermined pressure through the piping and spray nozzles into the thermostatic chamber at a constant volumetric flow rate as liquid or gasfied coolant is fed from a liquefied gas source through a heat exchanger to be sprayed out from one or plurality of spray nozzles provided in a thermostatic chamber onto an object or substance placed therein, comprising: spraying said coolant as a liquid coolant at an initial cooling step of said object or substance for cooling the same towards an intended cryogenic or semi-cryogenic level, detecting the temperature of said object or substance reaching said intended cryogenic or semi-cryogenic level or the proximity thereof, causing a temperature controller to respond to said detection for controlling the temperature of a heat source of said heat exchanger thereby to gasify said liquid coolant and to control the temperature of the resultant gasified coolant for bringing the temperature of said object or substance to a closer proximity of said intended cryogenic or semi-cryogenic level, and thereafter detecting the temperature of said gasified coolant, instead of detecting the temperature of said object or substance, to control the temperature of a heat source of said heat exchanger for thermostatically controlling the temperature of said object or substance to said intended cryogenic or semi-cryogenic level.

What is claimed is:

1. A cryostat process using a liquified gas, in which a coolant is fed from a liquified gas source through a heat exanger to be sprayed out from at least one spray nozzle provided in a thermostatic zone onto a material therein, comprising the steps of:

(a) spraying said coolant in the liquid phase as a first cooling step directly onto said material so as to localize the cooling treatment of said material to a limited space, and cooling said material towards an intended cryogenic temperature;

(b) detecting the temperature of said material as it reaches the proximity of said temperature; and, (c) causing a temperature controller to respond to said detected temperature so as to gasify said coolant for thermostatically controlling the temperature of said material to said intended temperature.

* * * * *